United States Patent [19]

Wagster et al.

[11] 4,265,436

[45] May 5, 1981

[54] WORKPIECE SUPPORT DEVICE AND AUXILIARY SUPPORT BODY ARRANGEMENT

[75] Inventors: Robert P. Wagster, Greensboro; Russell Pizzuto, Easton, both of Md.

[73] Assignee: Black & Decker Inc., Towson, Md.

[21] Appl. No.: 65,732

[22] Filed: Aug. 10, 1979

[51] Int. Cl.[3] ..... B25B 1/24

[52] U.S. Cl. ..... 269/274; 269/283

[58] Field of Search ..... 269/283, 274, 279, 139, 269/219, 220

[56] References Cited

U.S. PATENT DOCUMENTS

| | | | |
|---|---|---|---|
| 800,685 | 10/1905 | Scoggins | 269/283 |
| 1,393,083 | 10/1921 | Campbell | 269/283 |
| 2,340,316 | 2/1944 | Fest | 269/274 |
| 4,061,323 | 12/1977 | Beekenkamp | 269/283 |

*Primary Examiner*—Robert C. Watson

*Attorney, Agent, or Firm*—Frank J. Thompson; Edward D. Murphy; Leonard Bloom

[57] ABSTRACT

An improved arrangement for mounting an auxiliary workpiece support body to a workpiece support device includes a restraining means for selectively inhibiting and enabling motion of the auxiliary support body in the direction of a longitudinal axis while simultaneously enabling rotation of the body about the axis. The auxiliary support body includes a means for restraining jaw cladding bodies of different thicknesses on a workpiece support device and permitting rotary motion of the support body.

16 Claims, 7 Drawing Figures

WORKPIECE SUPPORT DEVICE AND AUXILIARY SUPPORT BODY ARRANGEMENT

BACKGROUND OF THE INVENTION

1. Field of the Invention

This invention relates to devices for supporting workpieces. The invention relates more particularly to an improved auxiliary support means for extending the usefulness of such devices.

2. Description of the Prior Art

Workpiece support devices are known for gripping and supporting a workpiece during working operations. A device of this type generally comprises a vise having a pair of jaw members and a means for adjusting the spacing between the jaw members for gripping and releasing the workpiece. The size of a workpiece which can be gripped by the device is limited principally by the maximum spacing between gripping faces of the jaw members when the jaws are adjusted to a maximum opening. The gripping spacing for a workpiece has been increased by the use of demountable, auxiliary support bodies, referred to as swivel pegs, which are mounted to the gripping members and which are adapted to receive and engage a workpiece. A swivel peg includes a mounting segment which is positioned in an aperture of the gripping member and is supported on a surface of the member. The auxiliary support body is adapted to engage an edge of a workpiece while a similar swivel peg on another gripping member of the device similarly engages and grips another edge of the workpiece. Since the swivel bodies are set back from the jaw faces of the gripping member, they thereby effectively provide an enlarged jaw opening for gripping workpieces larger than the spacing between the jaw members can accommodate.

An improved form of portable vise for supporting a workpiece during relatively moderate to light working operations, which is of relatively light weight and which can be fabricated relatively economically is described in copending U.S. Patent Application, Ser. No. 042,778, which was filed on May 29, 1979 and which is assigned to the assignee of this invention. In that workpiece support arrangement, a spacing between movable jaw members is limited by the size of various components. In order to effectively enlarge this jaw spacing, an aperture is formed in each jaw member and a swivel peg is demountably supported in each jaw member for gripping workpieces which are larger than the jaw members can accommodate. The workpiece support device as disclosed in the aforementioned U.S. Patent Application is fabricated principally of plastic elastomer materials and in order to provide for a relatively low cost manufacturing, the fabrication tolerances are not rigid. While the workpiece support vise described in this application has provided satisfactory operation, at times the application of a gripping force to the workpiece being supported by swivel pegs causes a slight deflection of the swivel members. During such a deflection, contact between the swivel member and workpiece loses its squareness and at times a workpiece may slip from the swivel grip. It would be advantageous to provide a support arrangement having auxiliary gripping bodies which remain relatively rigid during the application of a gripping force by these members to a supported workpiece.

It is often desirable to utilize a jaw member face cladding with a workpiece support device. The cladding comprises interchangeable bodies formed of a material which in one instance protects a workpiece from damage by the vise, and alternatively, when the vise is fabricated of a relatively soft material, protects the jaw face from deformation by the workpiece. A relatively noncomplex and inexpensive arrangement utilizing an auxiliary support body is disclosed in the aforesaid copending U.S. Patent Application for captivating the clad body on a jaw member. An auxiliary support body restraint in accordance with this invention has an elongated segment of predetermined length. Since it is desirable to interchangeably use clad bodies of different thicknesses the provision of an auxiliary support body having an elongated segment of predetermined length, which is restrained on a jaw member, and which is adapted to accommodate clad bodies of different thicknesses can result in a relatively costly and complex means for restraining the auxiliary support body.

SUMMARY OF THE INVENTION

Accordingly, it is an object of this invention to provide an improved arrangement of auxiliary support bodies and a vise having restraining means for inhibiting escape of a gripped workpiece from the auxiliary bodies.

Another object of the invention is to provide an improved arrangement for restraining movement of an auxiliary support body on a workpiece support device.

Another object of the invention is to provide a restraining means for inhibiting deflection of an auxiliary support body.

Another object of the invention is to provide a means for restraining movement of an auxiliary support body in an axial direction while enabling rotary movement of the body.

A further object of the invention is to provide a restraining means for selectively engaging and inhibiting movement of the auxiliary support body.

Another object of the invention is to provide an auxiliary support body having an improved means for restraining jaw cladding bodies of different thicknesses.

In accordance with a feature of the invention, first and second auxiliary support bodies are provided for use with a workpiece support device. The auxiliary support bodies each include an elongated segment, having a longitudinal axis, for positioning the bodies in apertures of first and second jaw members of the device. A restraining means is provided for inhibiting motion of a support body in the direction of a longitudinal axis thereby limiting deflection of the auxiliary support body.

In accordance with more particular features of the invention, the restraining means selectively inhibits motion in a longitudinal direction while enabling rotary motion of the auxiliary support body about the longitudinal axis. A particular restraining means comprises a keyhole shaped aperture formed in a jaw member of the device, and, a support body including a segment having a key shaped configuration which conforms with the keyhole configuration. Positioning the key segment in the aperture enables selective manual rotation of the support body between restrained and unrestrained positions.

In accordance with another feature of the invention, the auxiliary body includes a collar segment having a collar surface which engages a surface of the jaw member. The collar segment extends through an aperture formed in a clad body and has a length adapted to accommodate clad bodies of different thicknesses.

BRIEF DESCRIPTION OF THE DRAWINGS

These and other objects and features of the invention will become apparent with reference to the following specification and to the drawings wherein.

DETAILED DESCRIPTION

Figure 1:
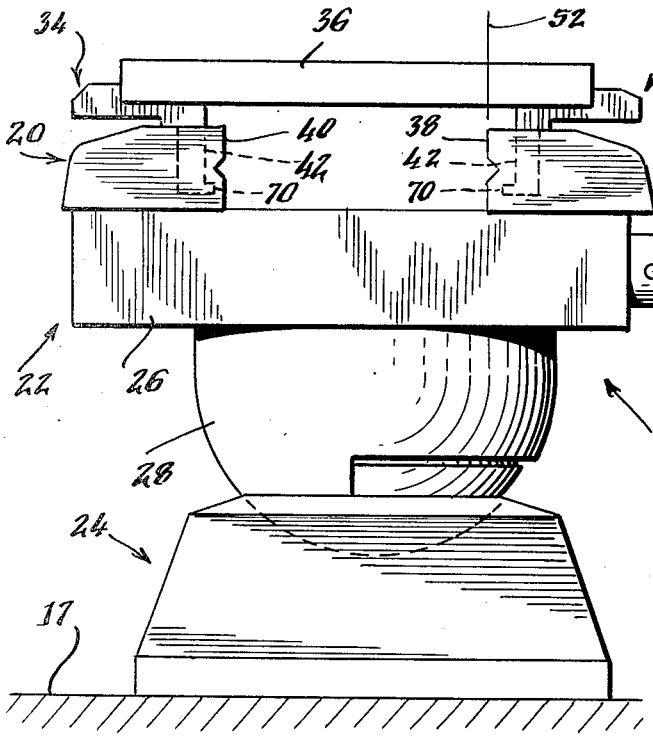
FIG. 1 is a side elevation view of a workpiece support device having an auxiliary support body arrangement constructed in accordance with features of the present invention.
Figure 2:
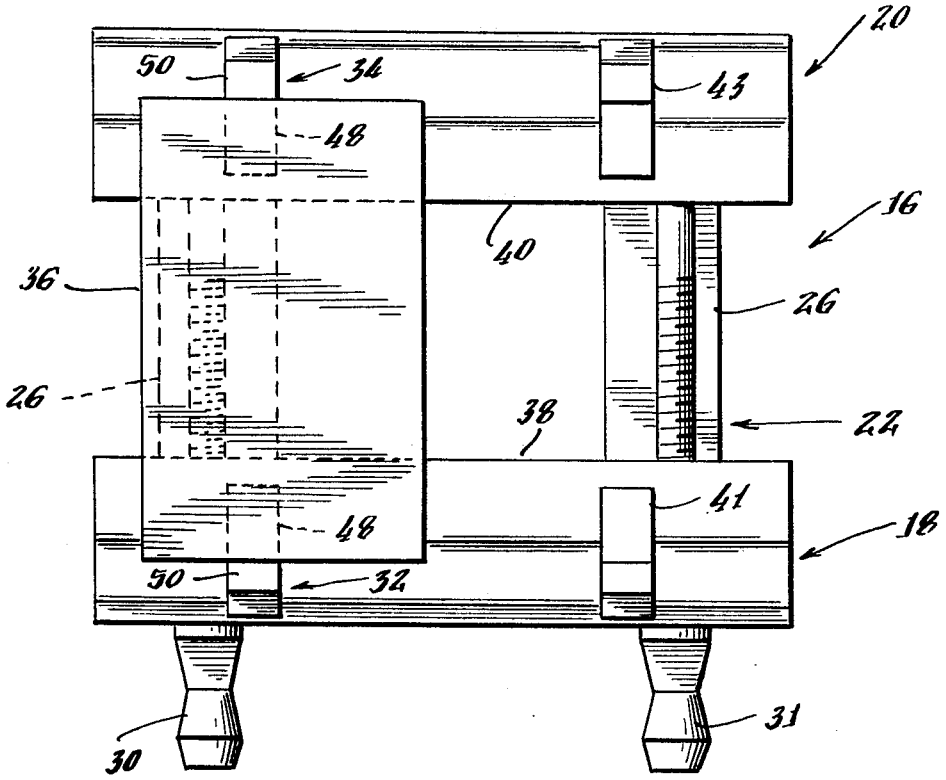
FIG. 2 is a plan view of the device of FIG. 1.
Figure 6:
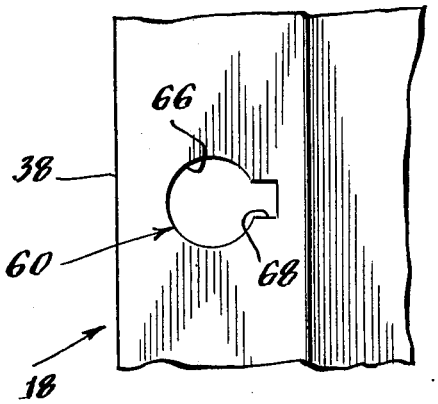
FIG. 6 is a fragmentary plan view of a surface of a jaw gripping member with auxiliary support body demounted and illustrating a keyhole shaped aperture formed in the jaw member; and, FIG. 7 is a perspective view of the auxiliary support body of FIG. 1.

Referring now to the drawings, and particularly to FIGS. 1 and 2, a vise 16 is shown supported on a surface 17 of a workbench or a support table. The vise 16 includes first and second workpiece gripping jaw members 18 and 20 and a means for supporting these members. The vise support means comprises a support body 22 and a base body 24. The support body 22 comprises an integrally formed frame member 26 and an integrally formed bowl shaped member 28. A means, including manually rotatable crank arms 30 and 31 are provided for varying the spacing and angularity between the jaw members 18 and 20 in order to grip and release a workpiece. The vise 16 and the means for varying the spacing between the jaw members 18 and 20 is disclosed in greater detail in the aforementioned copending U.S. Patent Application, the disclosure of which relating to said vise structure and the means for varying the spacing and angularity of the jaw members is incorporated herein by reference.

In order to increase the effective maximum spacing between the jaw members 18 and 20, first and second auxiliary support bodies 32 and 34 are provided and are demountably supported on the jaw members 18 and 20 respectively. As illustrated in FIG. 1, the support bodies 32 and 34 are adapted to grip and engage a workpiece 36 having a dimension which is greater than a maximum spacing between jaw faces 38 and 40 of the jaw members 18 and 20 respectively when these jaw members are adjusted to their maximum spacing.

Figure 3:
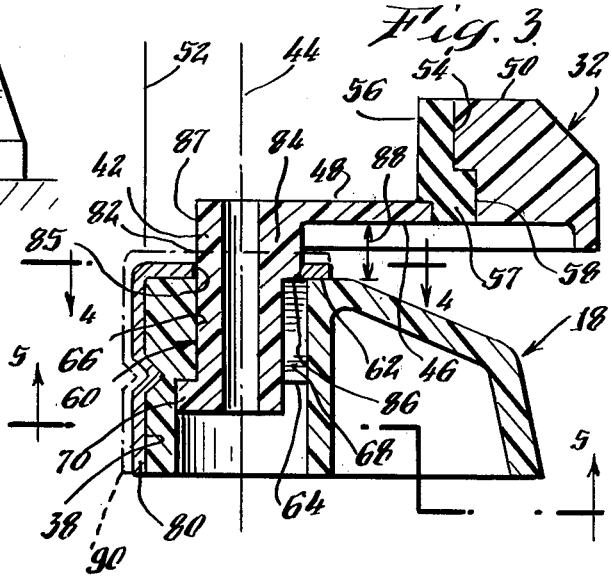
FIG. 3 is an enlarged, fragmentary view in section illustrating a jaw member and an auxiliary support body arrangement of FIG. 1.
Figure 4:
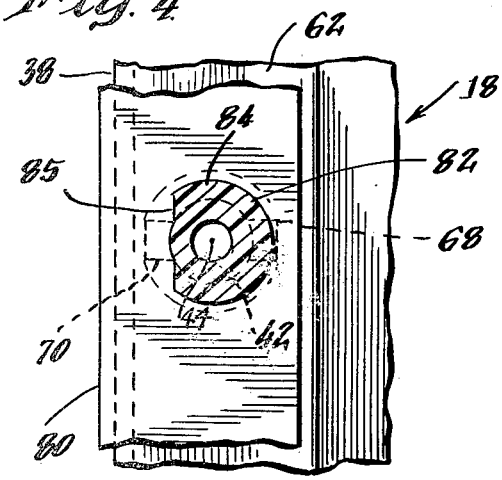
FIG. 4 is a fragmentary view taken along the lines 4—4 of FIG. 3.

The mounting of the auxiliary support bodies 32 and 34 to the jaw members is illustrated in greater detail in FIGS. 3 through 7. While the following description refers to the auxiliary support body 32 and jaw member 18, it will be understood that it also applies to the mounting of support body 34 to jaw member 20 as well as to mounting of other support bodies 41 and 43 (FIG. 2) to the jaw members. The auxiliary support body 32 includes a first, integrally formed elongated segment 42 of generally cylindrical configuration and having a longitudinal axis 44, a second integrally formed parallelpiped shaped segment 46 extending transversely to the segment 42 and having a flat, workpiece support surface 48, and, a third buttress segment 50 located at a distal part of the segment 46. The jaw face surface 38 of jaw member 18 extends in a plane 52 (FIG. 1) which plane is perpendicular to the plane of the drawing and extends out of the paper as viewed in FIGS. 1 and 3. The buttress segment 50 includes a workpiece gripping surface 54 which extends transversely to the surface 48 and preferably normal to the surface and, in the orientation of FIG. 3, is parallel to the plane 52. A body 56 of resilient material is positioned adjacent the surface 54 and is secured to the support body 32 by a segment 57 which engages an aperture 58 formed in the body 32.

Figure 5:
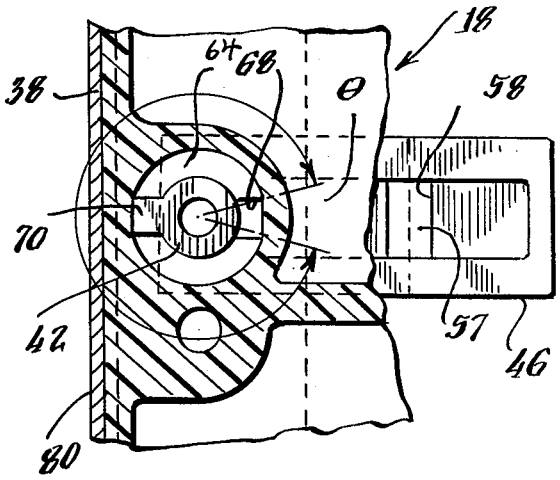
FIG. 5 is a fragmentary view taken along the lines 5—5 of FIG. 3.
Figure 7:
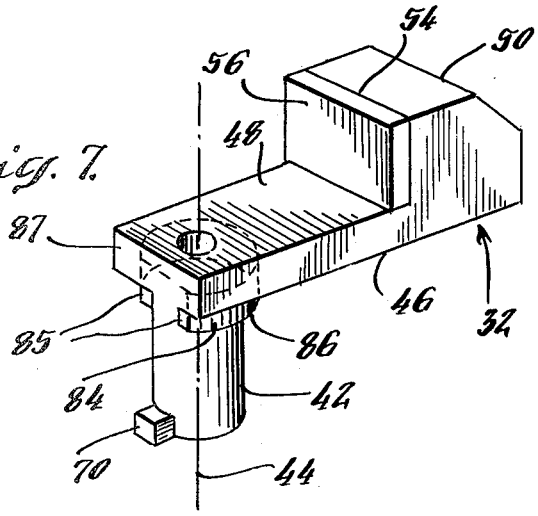

A means is provided for selectively restraining movement of the support body 32 in the direction of the longitudinal axis 44 while enabling rotary motion of the body over an arcuate distance. The restraining means comprises a keyhole shaped aperture 60, (FIG. 6) which is formed in the jaw member 18 and extends from a second, upper surface 62 of the jaw member to a lower surface 64 (FIG. 3). Surface 62 extends transversely to the plane 52 of jaw member surface 38. The cross sectional configuration of the keyhole shaped aperture includes a generally circular segment 66 (FIG. 6) which is concentric with the axis 44 and a generally rectangular shaped segment 68 which extends transversely to the axis 44. The circular segment 66 extends through the jaw member 18 between surfaces 62 and 64 in a direction parallel to plane 52 to provide a cylindrical shaped bore and the segment 68 extends through the jaw member 18 to provide an elongated slot. The restraining means further includes the first elongated segment 42 of the support body 32 having a key shaped configuration which is adapted to be positioned in the keyhole shaped aperture 60 and to engage an arcuate segment of the lower surface 64. The elongated segment 42 has a generally cylindrical shaped configuration which conforms with the cylindrical configuration of the aperture 60 and includes a tab 70 formed at a distal, lower part of the segment. Tab 70 has a generally rectangular configuration conforming with the rectangular configuration 68 of the keyhole shaped aperture 60. The support body 32 is mounted to the jaw member 18 by aligning the segment 70 with the aperture 68, fully inserting the elongated segment into the keyhold shaped aperture 60, and rotating the body 32 until the segment 70 engages the lower surface 64. Upon engagement, the segment 70 inhibits withdrawal of the body 32 and inhibits movement in the longitudinal direction 44. The segment 42 is dimensioned to provide a snug fit between the surface 64 and the tab segment 70. While the body is thus longitudinally restrained, it may be rotated over a substantially large angle ($\theta$) which as viewed in FIG. 5 is greater than 270° while simultaneously maintaining contact between the segment 70 and surface 64. The restraining means thus provides for selectively inhibiting and enabling movement of the elongated segment of the body 32 in the direction of the longitudinal axis 44 while permitting rotation of the body over the angle ($\theta$) in a restrained condition.

A jaw member cladding body 80 is provided and is positioned on the jaw member (FIG. 3). A similar clad body, not shown, is also positioned on the jaw member 20. The clad body includes an aperture 82 formed therein for orientating and maintaining the body 80 on the jaw member 18. The elongated segment 42 includes an arcuate shaped collar 84 having a surface 86 (FIG. 3) which engages surface 62 of jaw member 18. The collar extends through the aperture 82 formed in the clad body 80 and has a cross sectional configuration and dimension selected to maintain the clad body at the desired orientation. In the particular arrangement illustrated, the aperture 82 formed in the clad body 80 is circular and is concentric with the axis 44. The collar 84 has a cross sectional configuration comprising a segment of a circle, the circle being concentric with the axis 44. A flat segment 85 (FIG. 4) of the generally circular shaped collar 84 is provided to enable a flat, flush engagement between a workpiece and another gripping surface 87 of the body 32. This gripping arrangement is described and claimed in a copending U.S. Patent Application, Ser. No. 065,731, filed concurrently herewith and which is assigned to the assignee of the invention. The collar 84 is rotatable about the axis 44 within the aperture of the clad body 82. Collar 84 has a length 88 which is selected to enable the collar to extend through interchangeable clad bodies of differing thicknesses without binding of the body 32. In an exemplary arrangement, a clad body formed of a metal such as sheet steel can have a thickness which is substantially less than the thickness of a clad body formed of a polymer plastic, a fiber, or other similar cladding material. In FIG. 3, there is illustrated by dashed lines a clad body 90 having a thickness greater than the clad body 80 which can be interchangeably utilized with the support body 32. The maximum thickness of a clad body which can be utilized with the body 32 is determined by the length 88 of the collar. Clad bodies of different thicknesses are thus conveniently captivated on a jaw member, the auxiliary support body 32 is restrained from movement in a longitudinal direction and, at the same time the support body is enabled to rotate about the longitudinal axis.

An improved arrangement utilizing an auxiliary support body for supporting a workpiece has thus been described. The arrangement advantageously, selectively inhibits movement of the support body in a first, longitudinal direction while enabling rotation of the body about a longitudinal axis. Restraint thus imposed on a support body limits deflection of the support body and substantially reduces a tendency for a workpiece which is gripped between two auxiliary support bodies to escape from the grip of these two bodies. The auxiliary body further is adapted to maintain and position clad bodies of differing thicknesses while at the same time remaining free to rotate.

While there has been described a particular embodiment of the invention, it will be apparent to those skilled in the art that variations may be made thereto without departing from the spirit of the invention and the scope of the appended claims.

What is claimed is:

1. An improved arrangement for supporting a workpiece comprising:

(a) a workpiece support device having first and second workpiece gripping jaw members and means for varying the spacing between said members for gripping a workpiece therebetween;

(b) first and second auxiliary support bodies;

(c) said first and second auxiliary support bodies demountably and rotatably supported on said first and second jaw members respectively; and, (d) restraining means for selectively inhibiting and enabling demounting of said auxiliary bodies at predetermined rotational locations of said body.

2. The apparatus of claim 1 wherein said restraining means comprises key shaped apertures formed in said jaw members and said auxiliary bodies each include a key shaped segment for engaging said key shaped aperture.

3. The apparatus of claim 2 wherein said jaw members include upper and lower surfaces thereof, said key shaped aperture includes cylindrically shaped aperture segment extending between said upper and lower surfaces and an aperture segment extending radially from said cylindrical segment, said auxiliary body key shaped segment includes a generally cylindrically shaped segment and a segment extending radially therefrom at a location on said cylindrical segment for positioning adjacent said lower surface of said jaw member.

4. The apparatus of claim 3 wherein said key shaped body segment is rotatable about a longitudinal axis thereof for establishing engagement between said radial key segment and said lower surface.

5. An improved arrangement for supporting a workpiece comprising:

(a) a workpiece support device having first and second workpiece gripping jaw members and means for varying the spacing between said members for gripping a workpiece therebetween;

(b) each of said jaw members having a first workpiece gripping surface extending in a plane and a second surface extending transversely to said plane;

(c) each of said jaw members having a generally circular aperture formed therein and extending from said second surface parallel to said plane;

(d) first and second auxiliary support bodies rotatably positioned on said first and second jaw members respectively and each having a cylindrical shaped segment thereof extending into said aperture;

(e) restraining means for selectively enabling and inhibiting withdrawal of said bodies from said aperture at predetermined rotational locations of said support body; and, (f) said first and second auxiliary support bodies each including a surface thereof for gripping a workpiece between said surfaces and supporting a workpiece therebetween.

6. The apparatus of claim 5 wherein said restraining means for inhibiting axial movement of said auxiliary body comprises a third surface of said jaw member and a distal segment formed on said auxiliary body segment for engaging said third jaw surface.

7. The apparatus of claim 6 wherein said cylindrical segment has a longitudinal axis and said distal segment extends transversely to a longitudinal axis of said body segment.

8. The apparatus of claim 5 wherein said restraining means comprises a key shaped segment formed on said auxiliary body and a keyhole shaped aperture formed in said jaw member for receiving and engaging said body key shaped segment.

9. The apparatus of claim 7 wherein said aperture includes a cylindrical segment having a longitudinal axis and a rectangular shaped segment extending transversely to said axis, said aperture extends through said jaw from said first surface to said third surface, said auxiliary body includes an elongated cylindrically shaped segment having a longitudinal axis which is configured to conform with said aperture, a tab segment extending transversely to said axis of said cylindrical body segment at a distal location of said cylindrical segment, and said tab is configured to conform to the cross sectional configuration of said rectangular segment of said aperture.

10. An improved arrangement for supporting a workpiece comprising:

(a) a workpiece support device having first and second workpiece gripping jaw members and means for varying the spacing between said members for gripping a workpiece therebetween;

(b) said jaw members each including an aperture formed therein;

(c) first and second auxiliary support bodies each including an elongated segment having a longitudinal axis thereof;

(d) said first and second auxiliary bodies demountably supported on said first and second jaw members respectively and positioned for extension of said elongated segments into said apertures;

(e) an elongated body of jaw cladding material positioned on a jaw member;

(f) said cladding body having an aperture formed therein which is located concentrally with said aperture formed in said jaw member;

(g) said auxiliary support body including a collar segment which engages a surface of said jaw member adjacent said aperture formed in said jaw member; and, (h) said collar extending through said cladding body aperture for restraining said cladding body on said jaw member.

11. The apparatus of claim 10 wherein said collar is cylindrically shaped and said aperture in said jaw cladding member is circular shaped whereby said auxiliary support body is rotatable in said cladding body aperture.

12. An improved arrangement for supporting a workpiece comprising:

(a) a workpiece support device having first and second workpiece gripping jaw members and means for varying the spacing between said members for gripping a workpiece therebetween;

(b) first and second auxiliary support bodies each including an elongated segment having a longitudinal axis thereof for positioning said support bodies on said first and second jaw members respectively;

(c) said first and second jaw members including apertures formed therein for receiving and rotatably supporting said elongated segments for rotation about said axis; and (d) restraining means for enabling rotation of said support body about said axis and inhibiting movement of said support body in an axial direction at predetermined rotational locations of said support body.

13. The device of claim 12 wherein said restraining means enables movement in an axial direction at a predetermined rotational location of said support body.

14. An improved auxiliary workpiece support body for use with a vise for extending the effective opening of jaw members of the vise comprising a body having a first elongated, generally cylindrically shaped segment having a longitudinal axis thereof and a tab segment positioned at a distal location of said elongated segment and extending transversely to said longitudinal axis, a second integrally formed segment extending transversely to said first segment, and a third buttress segment located at a distal part of said second segment and having a workpiece gripping surface, said first segment having a key shaped configuration for extension into a keyhole shaped aperture of a vise jaw member for engaging the member.

15. The auxiliary support body of claim 14 wherein said elongated segment includes a collar integrally formed therein for engaging a support surface of the jaw member and having a length thereof.

16. A workpiece support device having first and second workpiece gripping jaw members and a means for supporting said members, said support means comprising a support body and a base body, said jaw gripping members, support body and base body formed of a polymer plastic, means including a manually rotatable crank for causing said jaw members to advance toward each other, said jaw members each including a gripping face, first and second auxiliary support bodies each including an elongated segment having a longitudinal axis thereof for positioning said support bodies on said first and second jaw members respectively, said first and second jaw members including apertures formed therein for receiving and supporting said elongated segments for rotation of said body in said aperture about said axis, said auxiliary bodies each including a gripping surface for gripping a workpiece therebetween, said auxiliary bodies subject to movement in an axial direction and deflectable upon the application of a gripping force to said workpiece whereby a grippied workpiece is subject to escape from captivation by said auxiliary bodies, and a restraining means for selectively inhibiting and enabling axial movement of said auxiliary bodies at predetermined rotational locations of said bodies.

* * * * *